US010001277B2

(12) United States Patent
Kanno et al.

(10) Patent No.: US 10,001,277 B2
(45) Date of Patent: Jun. 19, 2018

(54) METHOD FOR CONVEYING IMPURITIES IN PRESSURIZED FLUIDIZED BED INCINERATOR SYSTEM

(71) Applicants: TSUKISHIMA KIKAI CO., LTD., Tokyo (JP); SANKI ENGINEERING CO., LTD., Tokyo (JP)

(72) Inventors: Takamitsu Kanno, Tokyo (JP); Kazuyoshi Terakoshi, Tokyo (JP); Takafumi Yamamoto, Tokyo (JP); Kunihiko Koga, Tokyo (JP); Tomokazu Suyama, Tokyo (JP); Isamu Orito, Tokyo (JP)

(73) Assignees: TSUKISHIMA KIKAI CO., LTD., Tokyo (JP); SANKI ENGINEERING CO., LTD., Tokyo (JP)

( * ) Notice: Subject to any disclaimer, the term of this patent is extended or adjusted under 35 U.S.C. 154(b) by 691 days.

(21) Appl. No.: 14/386,736

(22) PCT Filed: Mar. 22, 2013

(86) PCT No.: PCT/JP2013/058331
§ 371 (c)(1),
(2) Date: Oct. 24, 2014

(87) PCT Pub. No.: WO2013/179744
PCT Pub. Date: Dec. 5, 2013

(65) Prior Publication Data

US 2015/0040806 A1 Feb. 12, 2015

(30) Foreign Application Priority Data

May 30, 2012 (JP) ..... 2012-122765

(51) Int. Cl.
*F23J 15/02* (2006.01)
*F23C 10/08* (2006.01)
(Continued)

(52) U.S. Cl.
CPC ..... *F23J 15/022* (2013.01); *F23C 10/002* (2013.01); *F23C 10/08* (2013.01); *F23C 10/16* (2013.01);
(Continued)

(58) Field of Classification Search
CPC ..... F23J 15/022; F23J 3/00; F23J 3/06; F23J 99/00; F23J 15/006; F23C 10/00–10/08;
(Continued)

(56) References Cited

U.S. PATENT DOCUMENTS 2,776,171 A 1/1957 Mylting
3,818,846 A * 6/1974 Reese ..... B01D 45/00 110/186
(Continued)

FOREIGN PATENT DOCUMENTS

EP 0030985 A1 7/1981
EP 0582049 A1 2/1994
(Continued)

*Primary Examiner* — Kenneth Rinehart
*Assistant Examiner* — Raymond Williamson
(74) *Attorney, Agent, or Firm* — Muncy, Geissler, Olds & Lowe, P.C.

(57) ABSTRACT

A method for efficiently conveying impurities in a pressurized fluidized incinerator system is provided. Cleaning gas is supplied to an upper valve, and thereafter, the upper valve is driven so as to communicate an upper discharge device and a tank. The upper discharge device is driven so as to convey the impurities from the dust collector to the tank, and thereafter, the upper discharge device is stopped and the upper valve is driven so as not to communicate the upper discharge device and the tank. Thereafter, the supply of the cleaning gas to the upper valve is stopped.

6 Claims, 4 Drawing Sheets

(51) Int. Cl.

| | |
|---|---|
| ***F23C 10/16*** | (2006.01) |
| ***F23J 3/00*** | (2006.01) |
| ***F23C 10/00*** | (2006.01) |
| ***F23G 5/44*** | (2006.01) |
| ***F23G 5/30*** | (2006.01) |

(52) U.S. Cl.
CPC ..... *F23G 5/30* (2013.01); *F23G 5/44* (2013.01); *F23J 3/00* (2013.01); *F23J 15/027* (2013.01); *F23G 2203/50* (2013.01); *F23G 2203/501* (2013.01); *F23G 2209/30* (2013.01)

(58) Field of Classification Search
CPC ..... F23G 5/30–5/32; F23G 5/50; F23G 5/00; B01D 46/48; B01D 46/4272
USPC ..... 110/165 A, 165 R, 216, 345; 137/15.06; 55/423, 430, 431, 432
See application file for complete search history.

(56) References Cited

U.S. PATENT DOCUMENTS

| | | | | |
|---|---|---|---|---|
| 5,199,356 | A * | 4/1993 | Hoffert ..... | F01K 23/08 110/233 |
| 2009/0025390 | A1 | 1/2009 | Christensen et al. | |

FOREIGN PATENT DOCUMENTS

| | | | |
|---|---|---|---|
| EP | 0919773 | A1 | 6/1999 |
| GB | 552816 | | 4/1943 |
| JP | 1-108320 | A | 4/1989 |
| JP | 2-22020 | Y2 | 6/1990 |
| JP | 7-63319 | A | 3/1995 |
| JP | 7-174327 | A | 7/1995 |
| JP | 2004-12073 | A | 1/2004 |
| JP | 2004-163000 | A | 6/2004 |
| JP | 2008-215703 | A | 9/2008 |

* cited by examiner

METHOD FOR CONVEYING IMPURITIES IN PRESSURIZED FLUIDIZED BED INCINERATOR SYSTEM

TECHNICAL FIELD

The present invention relates to a method for collecting and discharging dusts of a pressurized fluidized bed incinerator system for burning a material to be treated such as sewage sludge, biomass, municipal solid wastes, and industrial wastes, and more particularly to a method for conveying efficiently impurities such as dusts included in a flue gas and silica sand as a bed material made into small particles, which are collected by a dust collector provided between a pressurized fluidized bed incinerator and a turbocharger, to the outside of the system.

BACKGROUND ART

Conventionally, a pressurized fluidized bed incinerator system is known as incineration facilities where a material to be treated such as sewage sludge, biomass, and municipal solid wastes is burned, utilizing energy of a flue gas exhausted from an incinerator.

The pressurized fluidized bed incinerator system comprises a pressurized fluidized bed incinerator for burning the material to be treated, a turbocharger having a turbine rotated by the flue gas exhausted from the pressurized fluidized bed incinerator and a compressor rotated according to the rotation of the turbine for supplying a combustion air. Further in the pressurized fluidized bed incinerator system, a dust collector is provided between the pressurized fluidized bed incinerator and the turbocharger for collecting impurities contained in the flue gas so that damage caused by the impurities on bearing and impeller of the turbine can be prevented and air pollution control can be performed.

The pressurized fluidized bed incinerator system can be self-driven, because the total amount of the required combustion air for the combustion of the material to be treated is supplied from the turbocharger to the pressurized fluidized bed incinerator. Accordingly, it is known that a forced draft blower or an induced draft fan required in a conventional system are not necessary, resulting in reduced running costs.

Methods for conveying impurities from pressurized fluidized bed boilers or the like under pressurized state were proposed, in each of which, impurities contained in a flue gas are collected by a dust collector, and conveyed to the outside by way of a conveyer, a high pressure ash hopper, and a low pressure ash hopper provided below the dust collector (see Patent Literatures 1 to 4).

Patent Literature 1 discloses a technique in which fine combustible dusts contained in residue are dispersed by an air flow and a gas containing the fine dusts as well as a combustion air altogether are returned back to a tuyere of a melting furnace so that the fine combustible dusts are combusted, using two stages of dumpers and a pressure equalizing pipe system for equalization before and after the two stages of dumpers and between the dumpers to adjust the pressures between a dust collection system and the melting furnace having different pressures.

Patent Literature 2 and Patent Literature 3 disclose techniques each of which comprises a collector for collecting ash contained in a flue gas of a pressurized fluidized bed boiler using coal as fuel, a high pressure ash tank for receiving the ash under a maintained high pressure state of the flue gas, a separator for separating the ash from a conveyance gas in the high pressure ash tank, a pressure reducing device for releasing a gas from the high pressure ash tank, and an ash discharge valve and an airtight valve provided below the high pressure ash tank having a hopper-shaped lower portion while the ash is cooled to improve the reliability and the durability thereof.

After collecting dusts from a flue gas from a blast furnace with a high pressure, for a conventional apparatus for conveying the dusts, an intermediate hopper above a screw conveyer, a sealing valve for equally releasing the pressure at the upper side and the lower side of the intermediate hopper, and a dust separating rotary valve are required, resulting in the complicated and large apparatus. In order to solve this problem, Patent Literature 4 discloses a technique in which a disperser is provided below a dust discharge valve provided below a dust collector lower hopper, and a pipe having not only pressure equalization function but also capability of increasing the pressure is further provided between a disperser gas inlet and a dust collector outlet pipe with a pressure increasing blower interposed therebetween so that the dusts can be conveyed with the air to the dust hopper.

CITATION LIST

Patent Literature

Patent Literature 1: JP 2004-12073 A
Patent Literature 2: JP 7-174327 A
Patent Literature 3: JP 7-63319 A
Patent Literature 4: JP 2-22020 Y

SUMMARY OF INVENTION

Technical Problem

However, in each conventional method for conveying impurities of a pressurized fluidized bed boiler, in a valve provided between a conveyer and an ash hopper, impurities are attached to or entered into a valve body and a seal part and the like. Accordingly, the valve may not be closed and opened and abrasion may be occurred at the seal part of the valve so that seal function and lifetime of the valve are reduced.

In addition, when the seal part is damaged or the abrasion proceeds there due to the impurities attached to or entered into the valve body and the seal part and the like, a flue gas may leak from a dust collector, and may corrode devices provided around the valve such as a conveyer provided below the dust collector.

Accordingly, a main object of the present invention is to solve such problems.

Solution to Problem

The present invention solving the above problems and the operation and effect thereof are as follows.

The first aspect of the present invention is a method for conveying impurities in a pressurized fluidized bed incinerator system including a pressurized fluidized bed incinerator for burning a material to be treated, a turbocharger having a turbine rotated by a flue gas discharged from the pressurized fluidized bed incinerator and a compressor rotated according to the rotation of the turbine for supplying a compressed air as a combustion air to the pressurized fluidized bed incinerator, a dust collector for collecting the impurities in the flue gas, being provided between the pressurized fluidized bed incinerator and the turbocharger, and an apparatus for conveying the impurities, having an upper valve provided between an upper discharge device for discharging the impurities from the dust collector and a tank for saving the impurities, and a lower valve provided between a lower discharge device for discharging the impurities from the tank and the outside, the method comprising increasing a pressure in the tank, supplying a cleaning gas to the upper valve, and thereafter actuating the upper valve so as to communicate the upper discharge device and the tank, driving the upper discharge device so as to discharge the impurities from the dust collector to the tank and thereafter, stopping the upper discharge device, actuating the upper valve so as not to communicate the upper discharge device and the tank, and thereafter, stopping the supply of the cleaning gas to the upper valve.

(Operation and Effect)

The cleaning gas is supplied to the upper valve of the conveying device, and thereafter, the upper valve is actuated so as to communicate the upper discharge device and the tank, the impurities are discharged from the dust collector to the tank, and thereafter, the upper discharge device is stopped, and the upper valve is actuated so as not to communicate the upper discharge device and the tank, and thereafter, the supply of the cleaning gas to the upper valve is stopped. Accordingly, the impurities attached to the valve body and entered into the seal part in the upper valve can be removed before the impurities are started to be discharged and while the impurities are discharged. Therefore, the malfunctioning of the upper valve due to the impurities is prevented, and the impurities can be conveyed efficiently from the dust collector to the tank. In addition, since the abrasion of the seal part in the upper valve is suppressed, the frequency of maintenance and inspection for the upper valve is reduced, resulting in the long-term use of the upper valve.

The second aspect of the present invention is according to the first aspect of the present invention wherein the pressure in the tank is increased, the cleaning gas is supplied to the upper valve so as to remove the impurities from the upper valve, the supply of the cleaning gas to the upper valve is stopped, and thereafter, the upper valve is actuated so as to communicate the upper discharge device and the tank, the upper discharge device is driven so as to discharge the impurities from the dust collector to the tank, and thereafter, the upper discharge device is stopped, the cleaning gas is supplied to the upper valve so as to remove the impurities from the upper valve, the supply of the cleaning gas to the upper valve is stopped, and thereafter, the upper valve is actuated so as not to communicate the upper discharge device and the tank.

(Operation and Effect)

The cleaning gas is supplied to the upper valve of the apparatus for conveying the impurities so as to remove the impurities from the upper valve, the supply of the cleaning gas to the upper valve is stopped, and thereafter, the upper valve is actuated so as to communicate the upper discharge device and the tank, the cleaning gas is supplied to the upper valve so as to remove the impurities from the upper valve, the supply of the cleaning gas to the upper valve is stopped, and thereafter, the upper valve is driven so as not to communicate the upper discharge device and the tank. Therefore, the impurities in the upper valve can be efficiently removed.

The third aspect of the present invention is according to the first or second aspect of the present invention wherein the pressure in the tank is decreased, the cleaning gas is supplied to the lower valve, and thereafter, the lower valve is actuated so as to communicate the lower discharge device and the outside, the lower discharge device is driven so as to discharge the impurities from the tank to the outside, and thereafter the lower discharge device is stopped, the lower valve is actuated so as not to communicate the lower discharge device and the outside, and thereafter, the supply of the cleaning gas to the lower valve is stopped.

(Operation and Effect)

The cleaning gas is supplied to the lower valve of the apparatus for conveying the impurities, and thereafter, the lower valve is actuated so as to communicate the lower discharge device and the outside such as a conveyer, the impurities are discharged from the tank to the outside, and thereafter the lower discharge device is stopped, the lower valve is actuated so as not to communicate the lower discharge device and the outside, and thereafter, the supply of the cleaning gas to the lower valve is stopped. Accordingly, the impurities attached to the valve body and entered into the seal part in the lower valve can be removed before the impurities are started to be discharged and while the impurities are discharged. Therefore, the malfunctioning of the lower valve due to the impurities is prevented, and the impurities saved temporally in the tank can be conveyed efficiently to the outside. In addition, since the abrasion of the seal part in the lower valve is suppressed, the frequency of maintenance and inspection for the lower valve is reduced, resulting in the long-term use of the lower valve.

The fourth aspect of the present invention is according to the first or second aspect of the present invention wherein the pressure in the tank is decreased, the cleaning gas is supplied to the lower valve so as to remove the impurities from the lower valve, the supply of the cleaning gas to the lower valve is stopped and thereafter the lower valve is actuated so as to communicate the lower discharge device and the outside, the lower discharge device is driven so as to discharge the impurities from the tank to the outside, and thereafter the lower discharge device is stopped, the cleaning gas is supplied to the lower valve so as to remove the impurities from the lower valve, the supply of the cleaning gas to the lower valve is stopped and thereafter, the lower valve is actuated so as not to communicate the lower discharge device and the outside.

(Operation and Effect)

The cleaning gas is supplied to the lower valve of the apparatus for conveying the impurities so as to remove the impurities from the lower valve, the supply of the cleaning gas to the lower valve is stopped, and thereafter, the lower valve is actuated so as to communicate the lower discharge device and the outside such as the conveyer, the cleaning gas is supplied to the lower valve so as to remove the impurities from the lower valve, the supply of the cleaning gas to the lower valve is stopped, and thereafter, the lower valve is actuated so as not to communicate the lower discharge device and the outside. Therefore, the impurities in the lower valve can be efficiently removed.

The fifth aspect of the present invention is according to the first or second aspect of the present invention wherein the pressure in the tank is increased to a pressure higher than the pressure in the dust collector by 0 to 0.01 Mpa.

(Operation and Effect)

The pressure in the tank is increased to the pressure higher than the pressure in the dust collector by 0 to 0.01 Mpa. Therefore, the impurities can be stably discharged from the dust collector to the tank without being affected by the pressure difference. In addition, since the impurities are discharged from the dust collector to the tank not so powerfully, the abrasion of the inner wall of the tank and the like can be suppressed.

The sixth aspect of the present invention is according to the fifth aspect of the present invention wherein the pressure in the tank is increased by the combustion air discharged from the compressor of the turbocharger.

(Operation and Effect)

The pressure in the tank is increased by the combustion air discharged from the compressor of the turbocharger. Therefore, the pressure in the tank can be increased without the need of an additional device such as another blower and compressor. The pressure of the combustion air is higher than the pressure in the dust collector by about 5 kPa, and therefore, when the upper valve is in communication, the combustion air moves up from the tank toward the dust collector so that the dusts floating during the cleaning of the upper valve are less likely to attach again.

The seventh aspect of the present invention is according to the third or fourth aspect of the present invention wherein the pressure in the tank is decreased to a pressure outside.

(Operation and Effect)

The pressure in the tank is decreased to the pressure outside. Therefore, the impurities can be stably discharged from the tank to the outside such as the conveyer without being affected by the pressure difference. In addition, when the impurities are not conveyed, it is possible to maintain the pressure in the tank at the atmospheric pressure, resulting in reduced running costs.

The eighth aspect of the present invention is according to the first to seventh aspects of the present invention wherein the lower discharge device is stopped when the temperature in the tank becomes equal to or less than 50° C.

(Operation and Effect)

When the temperature in the tank becomes equal to or less than 50° C., the lower discharge device is stopped, resulting in a simple control system.

The ninth aspect of the present invention is according to the first to eighth aspects of the present invention wherein while the cleaning gas is not supplied to the upper valve, a cooling gas is supplied to the upper valve.

(Operation and Effect)

While the cleaning gas is not supplied to the upper valve, the cooling gas is supplied to the upper valve, and therefore, the upper valve can be maintained at a normal temperature. Accordingly, deterioration of a seal member and the like can be suppressed so that the frequency of maintenance and inspection for the upper valve is reduced, resulting in the long-term use of the upper valve.

Advantageous Effects of Invention

According to the above invention, the impurities can be conveyed efficiently, malfunctioning of the valves of the apparatus for conveying the impurities are suppressed, and leakage of the flue gas to the outside and corrosion of devices caused by the flue gas can be prevented.

DESCRIPTION OF EMBODIMENTS

The embodiment of the present invention will be hereinafter explained in details with reference to appended drawings. For easy understanding, the direction is indicated for the sake of convenience in the explanation, but it is to be understood that the configuration is not limited thereby.

Figure 1:
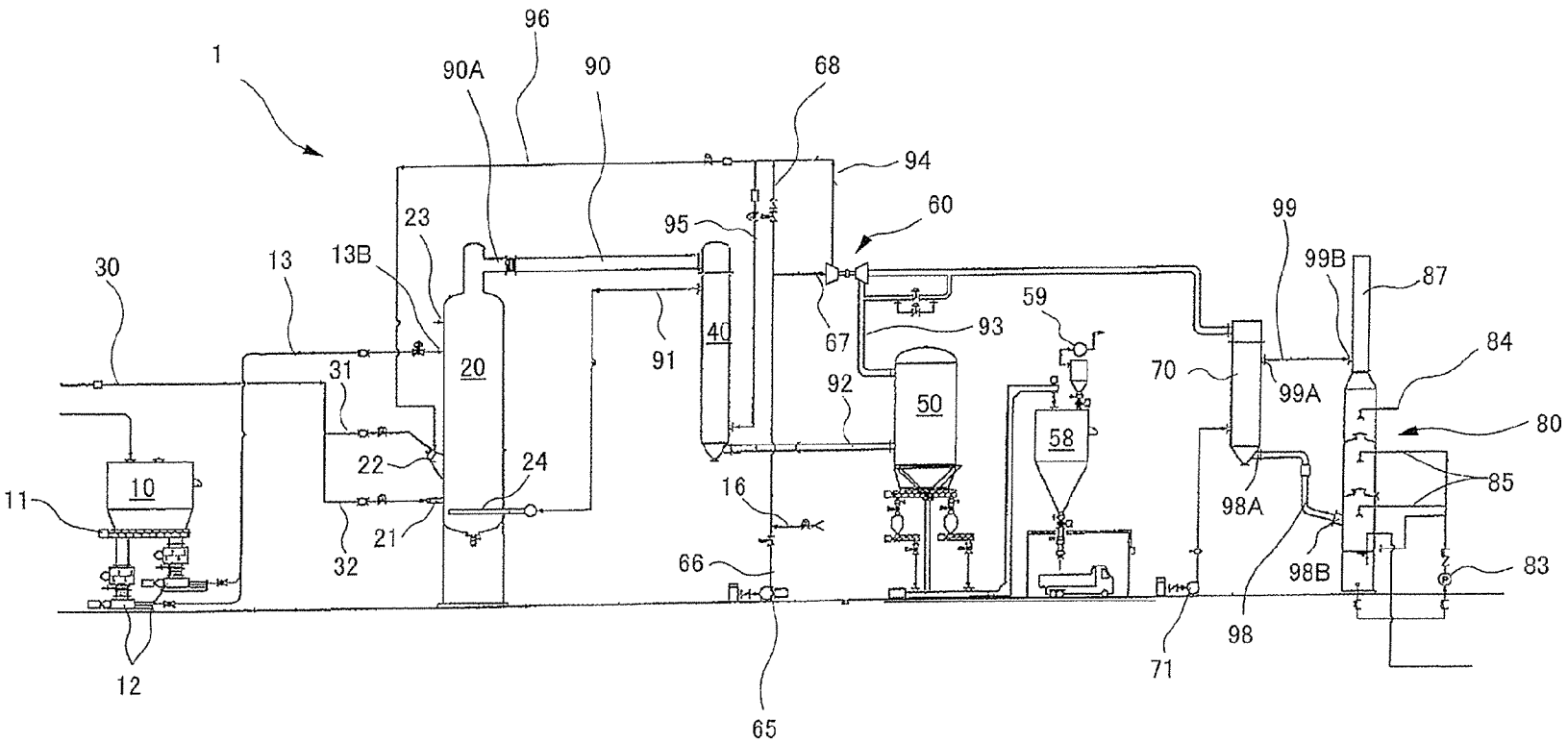
FIG. 1 is an explanatory diagram illustrating a pressurized fluidized bed incinerator system.

As shown in FIG. 1, the pressurized fluidized bed incinerator system 1 comprises a sludge hopper 10 for storing a material to be treated such as sludge, a pressurized fluidized bed incinerator 20 for burning the material to be treated fed from the sludge hopper 10, an air pre-heater 40 for heating a combustion air supplied to the pressurized fluidized bed incinerator 20 by using a flue gas exhausted from the pressurized fluidized bed incinerator 20, a dust collector 50 for removing powder dusts in the flue gas, a turbocharger 60 driven by the flue gas so as to supply the combustion air to the pressurized fluidized bed incinerator 20, a white smoke prevention pre-heater 70 for heating a white smoke prevention air supplied to an outlet of a scrubber 80 by using the flue gas discharged from the turbocharger 60, and the scrubber 80 for removing impurities in the flue gas.

(Sludge Hopper)

The material to be treated stored in the sludge hopper 10 is mainly sewage sludge of which water content is dehydrated to 70 to 85 percent by mass, and the material to be treated contains a combustible organic substance. It should be noted that since the material to be treated is not limited to the sewage sludge as long as it is an organic substance containing water, it may be biomass, municipal solid waste, and the like.

At the lower portion of the sludge hopper 10, a constant feeder 11 is provided so as to supply a predetermined amount of the material to be treated to the pressurized fluidized bed incinerator 20, and at the downstream side of the constant feeder 11, feed pumps 12 are provided so as to pressure the material to be treated to the pressurized fluidized bed incinerator 20. The feed pump 12 may be a processing cavity pump, a piston pump, and the like.

(Pressurized Fluidized Bed Incinerator)

The pressurized fluidized bed incinerator 20 is a combustion incinerator in which solid particles such as silica sand as a bed material having a predetermined particle size is filled up in the lower portion of the incinerator as fluidized medium, and is configured to burn the material to be treated fed from outside and the auxiliary fuel supplied as necessary while maintaining the fluidized state of a fluidized bed (hereinafter referred to as a sand bed) by using the combustion air supplied into the incinerator.

As shown in FIG. 1, an auxiliary fuel combustion apparatus 21 such as a gas spray and oil spray is provided in a lower portion of the incinerator at one side wall thereof so as to heat the silica sand as the bed material that has the particle size of about 400 to 600 μm and that is filled up in the pressurized fluidized bed incinerator 20. In the vicinity of the auxiliary fuel combustion apparatus 21 at the upper side thereof, a start-up burner 22 is arranged so as to heat the silica sand as the bed material during the start-up operation. An inlet 13B for the material to be treated is further arranged at the upper side of the start-up burner 22. In the vicinity of the inlet 13B at the upper side thereof, a water spray 23 is arranged so as to cool the flue gas by spraying cooling water into the incinerator.

A combustion air diffusion pipe 24 is arranged in the lower portion of the pressurized fluidized bed incinerator 20 at the other side wall thereof so as to supply the combustion air into the pressurized fluidized bed incinerator 20. A discharge port 90A is formed on the side wall of a head portion of the pressurized fluidized bed incinerator 20 having the smaller diameter so as to discharge the combustion gas generated by combustion of the auxiliary fuel, the material to be treated and the like, and water vapor generated by heating of the sand filtrate water, water contained in the material to be treated and the like, to the outside. In the present invention, the combustion gas or a gas formed by mixing the combustion gas and the water vapor is referred to as the flue gas.

(Air Pre-Heater)

The air pre-heater 40 is provided at the rear stage of the pressurized fluidized bed incinerator 20 so as to heat the combustion air to a predetermined temperature by indirectly exchanging heat between the combustion air and the flue gas discharged from the pressurized fluidized bed incinerator 20.

Figure 2:
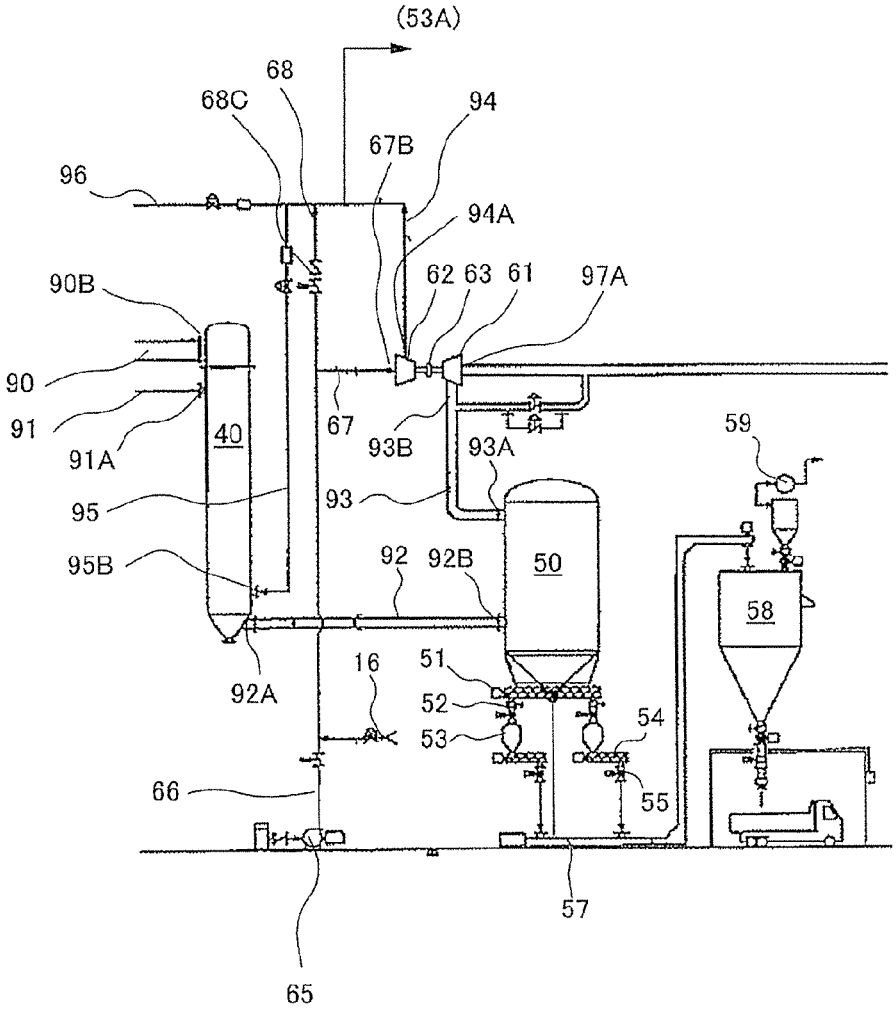
FIG. 2 is a partially enlarged diagram of FIG. 1.

As shown in FIGS. 1 and 2, an inlet 90B for the flue gas flown from the pressurized fluidized bed incinerator 20 is formed in the upper portion of the air pre-heater 40 at one side wall thereof, and an outlet 91A for discharging the combustion air from the air pre-heater 40 is formed in the vicinity of the inlet 90B at the lower side thereof. The inlet 90B for the flue gas is connected to the discharge port 90A of the pressurized fluidized bed incinerator 20 via a pipe 90. The outlet 91A for the combustion air is connected to a base portion of the combustion air diffusion pipe 24 in the pressurized fluidized bed incinerator 20 via a pipe 91.

An outlet 92A is formed in the lower portion of the air pre-heater 40 at the other side thereof so as to discharge the flue gas from the air pre-heater 40. In the vicinity of the outlet 92A at the upper side thereof, an inlet 95B is formed so as to supply the combustion air into the pre-heater. The air pre-heater is preferably a shell and tube heat exchanger.

(Dust Collector)

The dust collector 50 is provided at the rear stage of the air pre-heater 40 so as to remove the impurities such as fully fined silica sand and dusts contained in the flue gas blown from the air pre-heater 40.

An inlet 92B is formed in the lower portion of the dust collector 50 at one side wall thereof so as to supply the flue gas thereinto, and an outlet 93A is formed in the upper portion thereof to discharge a clean flue gas, from which the impurities and the like have been removed, to the outside of the dust collector. The inlet 92B for the flue gas is connected to the outlet 92A for the flue gas of the air pre-heater 40 via a pipe 92.

A filter such as a ceramic filter and a bug filter is arranged in the dust collector 50 in the midway in the up down direction thereof between the inlet 92B arranged at the lower portion thereof and the outlet 93A arranged at the upper portion thereof. The impurities and the like in the flue gas removed through the filter are temporarily saved in the bottom portion in the dust collector 50 and discharged outside periodically.

A pressure measurement means 50A is provided below the filter of the dust collector 50 at one side wall thereof to measure the pressure in the dust collector 50. The pressure measurement means 50A may be provided at any position as long as it can measure the pressure in the dust collector 50 and for example, it can be provided in the pipe 92 in proximity to the inlet 92B for the flue gas where the pressure is substantially the same as the pressure in the dust collector 50.

Figure 3:
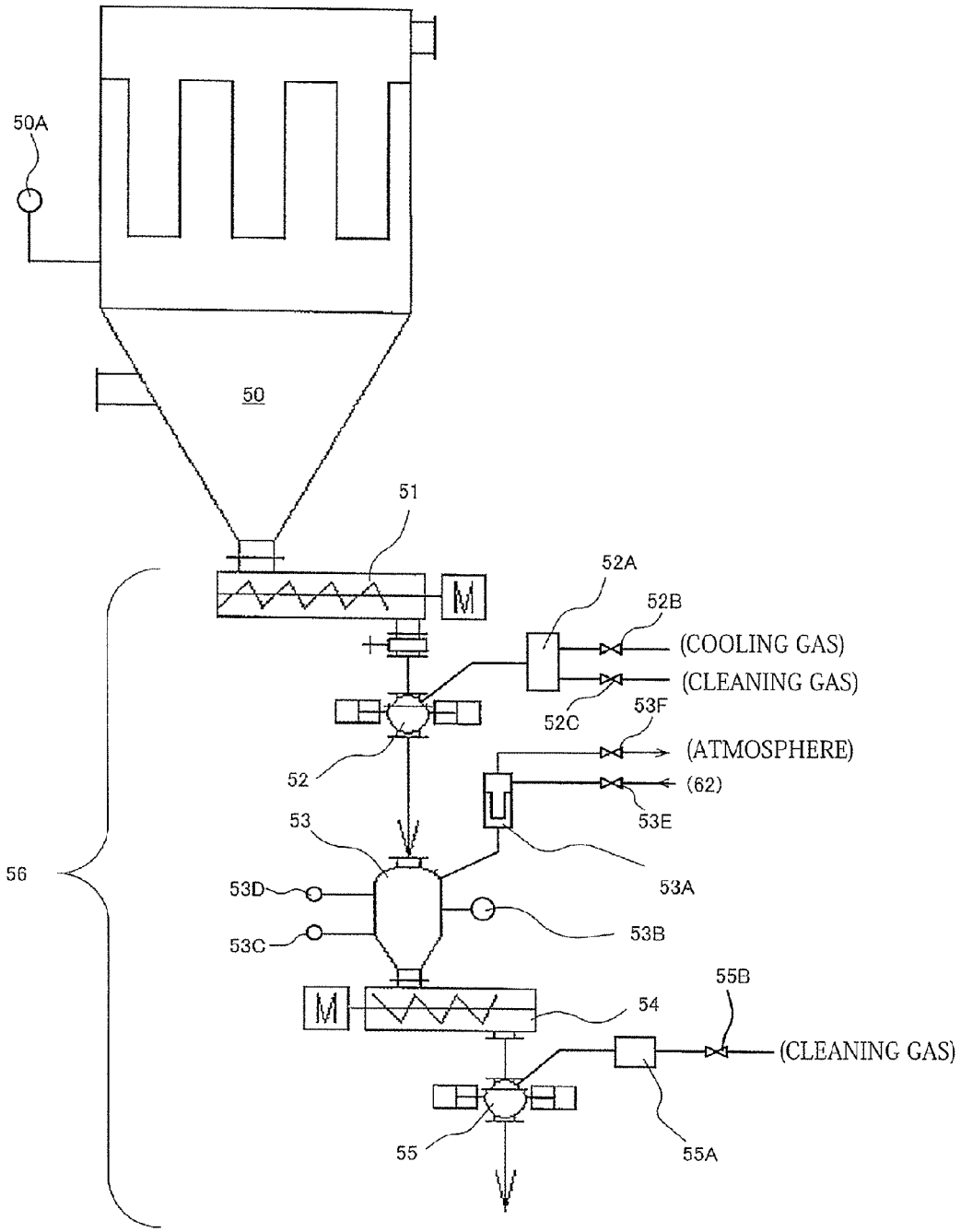
FIG. 3 is an enlarged view illustrating an essential portion of a dust collector.

An apparatus 56 for conveying the impurities, which is arranged below the dust collector 50, is shown in FIG. 3. The apparatus 56 has an upper discharge device 51, an upper valve 52, a tank 53, a lower discharge device 54, and a lower valve 55.

The upper discharge device 51 conveys the impurities such as dusts and the silica sand as the bed material contained in the flue gas from the dust collector 50 to the tank 53, and a screw conveyer, a cone valve, a rotary valve, a swing, a valve dumper, a pinch valve, and a slide gate can be used for the upper discharge device.

The upper valve 52 is provided between the upper discharge device 51 and the tank 53, and a gate valve and a ball valve can be used, but a non-sliding ball valve can be used preferably for the upper valve 52. A cleaning device 52A is provided in the upper valve 52 so as to supply a cleaning gas such as air to a drive portion, a contact portion between a valve body and a seal member in order to remove the impurities attached to or entered into the drive portion or the contact portion between the valve body and the seal member.

The cleaning device 52A has pipes and valves, and is connected to a cleaning gas inlet (not shown) provided in the upper valve 52 via a pipe, a hose or the like. To the cleaning device 52A, from each supply source (not shown) of the compressed air via pipes, a compressed gas for cleaning (cleaning air) is supplied so as to clean the upper valve 52 when it is actuated and a compressed gas for cooling (cooling air) is supplied so as to cool the valve body while the upper valve 52 is stopped.

The pressure of the compressed air for cleaning is preferably 0.4 to 0.5 Mpa, and the pressure of the compressed air for cooling is preferably 0.14 to 0.16 Mpa. A valve 52B and a valve 52C are provided in the pipe for the compressed gas for cleaning and the pipe for the compressed gas for cooling respectively, so as to control the supplying. According to a signal given by a control device, the valves 52B, 52C are controlled so as to select the type of the compressed gas to be supplied to the upper valve 52. In this case, the control device may be a device equipped to the cleaning device 52A or may be a control device for a fluidized bed incinerator system with a turbocharger. The cleaning gas may be a compressed air provided from, e.g., an air compressor and a turbocharger supplied separately and compressed nitrogen supplied separately.

When the upper valve 52 is stopped, from the cleaning device 52A, the compressed gas for cooling is supplied toward the upper valve so that the valve body and the seal member are cooled. On the other hand, when the upper valve 52 is actuated, the supply of the compressed gas for cooling is stopped and the compressed gas for cleaning is supplied.

The tank 53 has an air supply and exhaust device 53A for increasing or decreasing the pressure therein, a pressure measurement means 53B for detecting the pressure, a level meter 53C for measuring the amount of impurities saved therein, and a thermometer 53D for measuring the temperature therein.

The air supply and exhaust device 53A has a bug filter, an air supply pipe, an air exhaust pipe, an air supply valve, an air discharge valve, and the like in order to prevent leaking of dusts and the like to the outside when the gas in the tank 53 is exhausted. One end of the air supply pipe is connected to an apparatus for supplying the compressed air such as an air compressor and a turbocharger so as to supply a gas for increasing the pressure in the tank 53. In particular, it is preferable that the compressed air generated by the turbocharger 60 explained later is used for the gas for increasing the pressure, because by doing so, the pressure in the tank 53 can be increased to be slightly higher than the pressure in the dust collector 50. In this case, as shown in FIG. 2, a pipe branched from a pipe 94 at the outlet-side of the compressor 62 is connected to the air supply and exhaust device 53A via an air supply valve 53E. On the other hand, one end of the air exhaust pipe is open to the atmosphere.

The air supply pipe is preferably arranged so that the compressed air can be supplied into the tank 53 from the outside of the bug filter at a surface thereof the dusts are attached to. By doing so, the dusts attached to the bug filter can be prevented from entering into the tank 53 when the air is supplied. The air supply pipe and the air exhaust pipe are provided with the air supply valve 53E and an air exhaust valve 53F, respectively and they are controlled so as to adjust the pressure in the tank 53.

In other embodiments, the pipe connected to the bug filter may be used for both the air supply and the air exhaust pipes. In this case, the other end side of the pipe is branched into two pipes, which may be used as the air supply pipe and the air exhaust pipe, respectively. By doing so, the pipe can be connected to the bug filter at one place, resulting in an improved maintenance property. In addition, if the pressure in the tank 53 is continuously measured for observation with the pressure measurement means 53B provided in the tank 53, the damage of the upper discharge device 51, the upper valve 52, the lower discharge device 54, the lower valve 55, and the like can be predicted.

Below the tank 53 of the apparatus 56 for conveying the impurities, the lower discharge device 54 is provided so as to convey the impurities from the tank 53 to a conveyer 57, and the lower valve 55 is provided below the lower discharge device 54. The lower valve 55 has a cleaning device 55A for supplying a clean air to a drive portion so as to remove the impurities attached to or enter into the drive portion.

A screw conveyer, a cone valve, a rotary valve, a swing, a valve dumper, a pinch valve, and a slide gate can be used for the lower discharge device 54. The cleaning device 55A may have the same structure as the cleaning device 52A.

The impurities discharged to the conveyer 57 are conveyed by the conveyer 57 to the hopper 58 where they are temporarily saved and they are conveyed to the outside by a vehicle with a regular interval of time. A valve 59 is provided on the top surface of the hopper 58 so as to discharge odor and the like generated by the impurities saved in the hopper 58 to the outside.

(Turbocharger)

The turbocharger 60 is arranged at the rear stage of the dust collector 50, and has a turbine 61 rotated by the flue gas blown from the dust collector 50, a shaft 63 for transmitting rotation of the turbine 61, and a compressor 62 for generating the compressed air when the rotation is transmitted by the shaft 63 to the compressor 62. The generated compressed air is supplied, as the combustion air, to the pressurized fluidized bed incinerator 20.

An inlet 93B is formed in a lower portion of the turbocharger 60 at the turbine 61-side wall thereof (at which a perpendicular line intersects to the shaft 63) so as to supply a clean flue gas from which the impurities have been removed by the dust collector 50, into the turbocharger. An outlet 97A is formed in a downstream side of the turbocharger at the turbine 61-side wall thereof (in parallel with the shaft 63) so as to discharge the flue gas from the turbocharger 60. The inlet 93B for the flue gas is connected to the outlet 93A of the dust collector 50 via a pipe 93.

An inlet 67B is formed in the upstream side of the turbocharger 60 at the compressor 62-side wall thereof (in parallel with the shaft 63) so as to suction the air into the compressor. A discharge port 94A is formed in the upper side of the turbocharger at the turbine 61-side wall thereof (at which a perpendicular line intersects to the shaft 63) so as to discharge the compressed air, which has been made by compressed the sucked air to 0.05 to 0.3 MPa to the outside. The inlet 67B for the outside air sucks the air via pipes 16, 67. In addition, it is also connected via the pipes 66, 67 to a start-up blower 65, which supplies the combustion air to the pressurized fluidized bed incinerator 20 during the start-up operation. On the other hand, the discharge port 94A for the compressed air is connected to the inlet 95B of the air pre-heater 40 via the pipe 94 and a pipe 95 and to the rear portion of the start-up burner 22 of the pressurized fluidized bed incinerator 20 via the pipe 94 and a pipe 96.

(Start-Up Blower)

The start-up blower 65 supplies the fluidized air to the pressurized fluidized bed incinerator 20 and the combustion air to the start-up burner 22 during the start-up operation of the pressurized fluidized bed incinerator system 1. The start-up blower 65 is connected to the rear portion of the start-up burner 22 arranged at the pressurized fluidized bed incinerator 20 via a pipe 66, a pipe 68 and the pipe 96, connected to the inlet 95B for the combustion air of the air pre-heater 40 via the pipe 66, the pipe 68, and the pipe 95, and connected to the inlet 67B of the compressor 62 of the turbocharger 60 via the pipe 66 and a pipe 67.

(White Smoke Prevention Pre-Heater)

The white smoke prevention pre-heater 70 indirectly exchanges heat between the flue gas discharged from the turbocharger 60 and the white smoke prevention air supplied from a white smoke prevention fan in order to prevent generation of white smoke of the flue gas discharged outside from a stack 87. With the heat exchange, the flue gas is cooled while the white smoke prevention air is heated. The flue gas that has been heat-exchanged and cooled by the white smoke prevention pre-heater 70 is blown to the scrubber 80 provided at the rear stage of the white smoke prevention pre-heater. A shell and tube heat exchanger, a plate heat exchanger and the like can be used for the white smoke prevention pre-heater 70.

(Scrubber)

The scrubber 80 prevents discharge of the impurities contained in the flue gas outside. The stack 87 is provided at the top of the scrubber 80.

As shown in FIG. 1, an inlet 98B is formed in the lower portion of the scrubber 80 at one side wall thereof so as to supply the flue gas discharged from the white smoke prevention pre-heater 70 into the scrubber, and an inlet 99B is formed in the lower portion of the stack 87 at one side thereof so as to supply the white smoke prevention air into the stack 87. The inlet 98B for the flue gas is connected to an outlet 98A for the flue gas formed in the lower portion of the white smoke prevention pre-heater 70 via a pipe 98. The inlet 99B for the white smoke prevention air is connected to an outlet 99A for the white smoke prevention air formed in the upper portion of the white smoke prevention pre-heater 70 via a pipe 99.

The flue gas is supplied to the scrubber 80 where the impurities and the like are removed from the flue gas and the white smoke prevention air and the flue gas are mixed so as to be discharged outside from the stack 87.

Now, a method will be explained for conveying the impurities such as the dusts, the silica sand as the bed material made into small particles and the like from the dust collector 50 to the outside.

Figure 4:
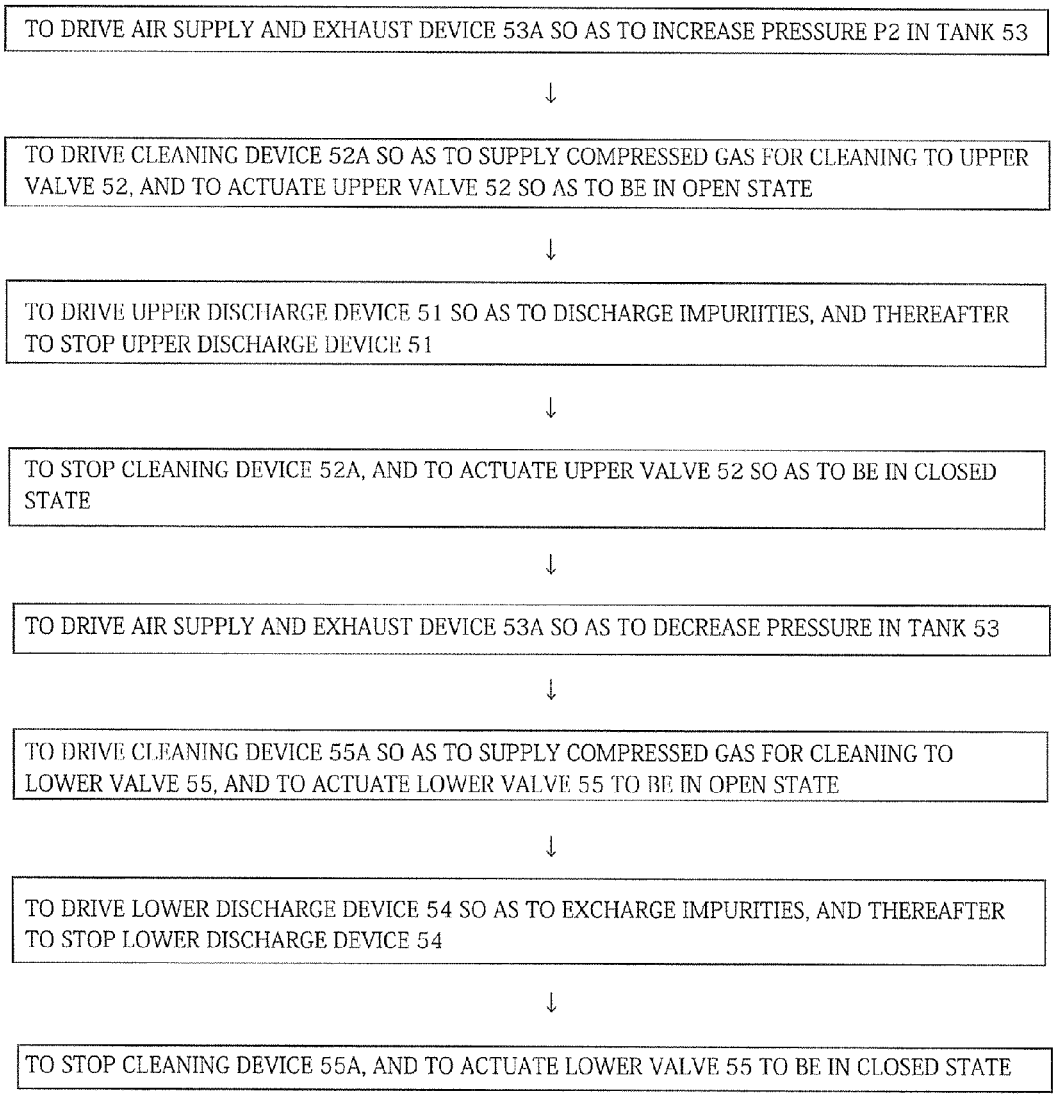
FIG. 4 is a flowchart illustrating a method for conveying impurities.

In order to prevent a large amount of the impurities from flowing out from the dust collector 50 to the tank 53, as shown in FIG. 4, the status of the air supply valve 53E of the air supply and exhaust device 53A is switched from a closed state to an open state so as to communicate the tank 53 and the turbocharger 60 for increasing the pressure in the tank 53. The pressure in the tank 53 is assumed to be pressure P2.

Then, after the pressure P2 in the tank 53 measured with the pressure measurement means 53B is increased to be a value X set on the basis of pressure P1 in the dust collector 50 measured with the pressure measurement means 50A, the air supply valve 53E of the air supply and exhaust device 53A is actuated from the open state to the closed state. The value X may be at least the same as or more than the pressure P1. For example, it can be set as necessary within a range indicated by the following expression.

$$X=P1+\alpha(\alpha\text{: 0 to 0.01 MPa})$$

The value X can be changed as necessary in accordance with a result measured with the pressure measurement means 50A.

In order to prevent the malfunctioning of the upper valve 52 and the abrasion of the seal part due to the impurities attached to or entered into the drive portion or the contact portion between the valve body and the seal member, the status of the valve 52B is switched from the open state to the closed state so as to stop the supply of the compressed gas for cooling, which has been supplied from the cleaning device 52A to the upper valve 52, the status of the valve 52C is switched from the closed state to the open state so as to supply the compressed air for cleaning to the upper valve 52 for removing the impurities from the contact portion between the valve body and the seal member and the like and thereafter, the upper valve 52 is actuated so as to switch from the closed state to the open state.

Subsequently, the upper discharge device 51 is driven for a predetermined time so as to convey a predetermined amount of the impurities to the tank 53 via the upper valve 52 and thereafter, the upper discharge device 51 is stopped. Alternatively the upper discharge device 51 is not driven for the predetermined time, instead it is driven until an amount of the impurities conveyed into the tank 53, that is measured with the level meter 53C provided in the tank 53, becomes to be the same as or more than a certain level and thereafter, the upper discharge device 51 is stopped.

Then, the upper valve 52 is actuated so as to switch from the open state to the closed state.

When the upper discharge device 51 is driven and stopped as explained above, the compressed gas for cleaning is continuously supplied from the cleaning device 52A to the upper valve 52 in order to prevent the impurities, which have been conveyed by the upper discharge device 51, from attaching to or entering into the contact portion between the valve body and the seal member and the like.

Alternatively it is possible when the upper discharge device 51 is driven and stopped, the supply of the compressed gas for cleaning from the cleaning device 52A to the upper valve 52 is stopped, and after the upper discharge device 51 is stopped, the supply of the compressed gas for cleaning from the cleaning device 52A to the upper valve 52 is resumed.

In order to prevent a large amount of the impurities from flowing out from the tank 53 to the conveyer 57, the discharge valve 53F of the air supply and exhaust device 53A is actuated from the closed state to the open state for discharging the compressed air in the tank 53 to the atmosphere.

Then, after the pressure P2 in the tank 53 measured with the pressure measurement means 53B becomes an atmospheric pressure P3, the discharge valve 53F of the air supply and exhaust device 53A is actuated from the open state to the closed state.

In order to prevent the malfunctioning of the lower valve 55 and the abrasion of the seal part due to the impurities attached to or entered into the drive portion or the contact portion between the valve body and the seal member, the status of the valve 55B is switched from the closed state to the open state so as to supply the compressed gas for cleaning from the cleaning device 55A to the lower valve 55 for removing the impurities from the contact portion between the valve body and the seal member and the like and thereafter, the lower valve 55 is actuated from the closed state to the open state.

Subsequently, the lower discharge device 54 is driven for a predetermined time so as to convey a predetermined amount of the impurities to the conveyer 57 outside via the lower valve 55 and thereafter, the lower discharge device 54 is stopped. Alternatively the lower discharge device 54 is not driven for the predetermined time, instead it is driven until an amount of the conveyed and saved impurities in the tank 53, that is measured with the level meter 53C provided in the tank 53, becomes to be the same as or less than a certain level and thereafter, the lower discharge device 54 is stopped.

The temperature in the tank 53 changes according to the amount of the impurities saved in the tank 53, when the amount of saved impurities is high, the temperature in the tank 53 is increased due to potential heat of the impurities, and when the amount of saved impurities is low, the temperature in the tank 53 is decreased. Therefore, according to the temperature measured by the thermometer 53D provided in the tank 53, the lower discharge device 54 may be controlled to drive and stop, and for example, when the temperature measured by the thermometer 53D becomes equal to or less than 50° C., the lower discharge device 54 is preferably stopped.

Then, the lower valve 55 is actuated from the open state to the closed state.

When the lower discharge device 54 is driven and stopped as explained above, the compressed gas for cleaning is continuously supplied from the cleaning device 55A to the lower valve 55 in order to prevent the impurities, which have been conveyed by the lower discharge device 54, from attaching to or entering into the contact portion between the valve body and the seal member and the like.

The cleaning device 55A can be configured so as to supply both the compressed air for cooling and the compressed air for cleaning. Further, when the upper discharge device 51 is driven and stopped, the supply of the compressed gas for cleaning from the cleaning device 55A to the lower valve 55 is stopped, and after the lower discharge device 54 is stopped, the supply of the compressed gas for cleaning from the cleaning device 55A to the lower valve 55 is resumed.

Subsequently, as described above, the impurities and the like conveyed onto the conveyer 57 are further conveyed by the conveyer 57 to the ash hopper 58 where they are temporarily saved, and thereafter they are conveyed to the outside by a vehicle with a regular interval of time.

REFERENCE SIGNS LIST

1 pressurized fluidized bed incinerator system
20 pressurized fluidized bed incinerator

50 dust collector
51 upper discharge device
52 upper valve
52A cleaning device
53 tank
53A air supply and exhaust device
53B pressure measurement means
54 lower discharge device
55 lower valve
55A cleaning device
56 apparatus for conveying the impurities
57 conveyer
60 turbocharger
61 turbine
62 compressor

The invention claimed is:

1. A method for conveying impurities in a pressurized fluidized bed incinerator system including a pressurized fluidized bed incinerator for burning a material to be treated, a turbocharger having a turbine rotated by a flue gas discharged from the pressurized fluidized bed incinerator and a compressor rotated according to the rotation of the turbine for supplying a compressed air as a combustion air to the pressurized fluidized bed incinerator, a dust collector for collecting the impurities in the flue gas, being provided between the pressurized fluidized bed incinerator and the turbocharger, and an apparatus for conveying the impurities, having an upper valve provided between an upper discharge device for discharging the impurities from the dust collector and a tank for saving the impurities, and a lower valve provided between a lower discharge device for discharging the impurities from the tank and a conveyor for conveying the impurities to a hopper, the method comprising the following steps:

the pressure in the tank is increased, the cleaning gas is supplied to the upper valve so as to remove the impurities from the upper valve, the supply of the cleaning gas to the upper valve is stopped, and thereafter, the upper valve is actuated so as to communicate the upper discharge device and the tank, the upper discharge device is driven so as to discharge the impurities from the dust collector to the tank, and thereafter, the upper discharge device is stopped, the supply of the cleaning gas to the upper valve is resumed so as to remove the impurities from the upper valve, the supply of the cleaning gas to the upper valve is stopped, and thereafter, and the upper valve is actuated so as not to communicate the upper discharge device and the tank, wherein the upper valve is actuated so as not to communicate the upper discharge device and the tank, and thereafter, wherein the pressure in the tank is decreased to an atmospheric pressure, the cleaning gas is supplied to the lower valve, and thereafter, wherein the lower valve is actuated so as to communicate the lower discharge device and the conveyor, wherein the lower discharge device is driven so as to discharge the impurities from the tank to the conveyor, and thereafter the lower discharge device is stopped, wherein the lower valve is actuated so as not to communicate the lower discharge device and the conveyor, and thereafter, and wherein the supply of the cleaning gas to the lower valve is stopped.

2. The method for conveying impurities in the pressurized fluidized bed incinerator system according to claim 1, wherein the pressure in the tank is increased to a pressure higher than the pressure in the dust collector, and a pressure differential between the tank and the dust collector ranges from more than 0 MPa to 0.01 MPa.

3. The method for conveying impurities in the pressurized fluidized bed incinerator system according to claim 2, wherein the pressure in the tank is increased by the combustion air discharged from the compressor of the turbocharger.

4. The method for conveying impurities in the pressurized fluidized bed incinerator system according to claim 1, wherein the lower discharge device is stopped when the temperature in the tank becomes equal to or less than 50° C.

5. A method for conveying impurities in a pressurized fluidized bed incinerator system including:

a pressurized fluidized bed incinerator for burning a material to be treated;

a turbocharger having a turbine rotated by a flue gas discharged from the pressurized fluidized bed incinerator and a compressor rotated according to the rotation of the turbine for supplying a compressed air as a combustion air to the pressurized fluidized bed incinerator;

a dust collector for collecting the impurities in the flue gas, being provided between the pressurized fluidized bed incinerator and the turbocharger; and an apparatus for conveying the impurities, having an upper valve provided between an upper discharge device for discharging the impurities from the dust collector and a tank for saving the impurities, and a lower valve provided between a lower discharge device for discharging the impurities from the tank and a conveyor for conveying the impurities to a hopper, the method comprising the following steps:

the pressure in the tank is increased;

the cleaning gas is supplied to the upper valve so as to remove the impurities from the upper valve;

the supply of the cleaning gas to the upper valve is stopped, and thereafter;

the upper valve is actuated so as to communicate the upper discharge device and the tank;

the upper discharge device is driven so as to discharge the impurities from the dust collector to the tank, and thereafter;

the upper discharge device is stopped;

the supply of the cleaning gas to the upper valve is resumed so as to remove the impurities from the upper valve, the supply of the cleaning gas to the upper valve is stopped, and thereafter; and the upper valve is actuated so as not to communicate the upper discharge device and the tank, wherein the upper valve is actuated so as not to communicate the upper discharge device and the tank, and thereafter, wherein the pressure in the tank is decreased to an atmospheric pressure, the cleaning gas is supplied to the lower valve so as to remove the impurities from the lower valve, the supply of the cleaning gas to the lower valve is stopped and thereafter, wherein the lower valve is actuated so as to communicate the lower discharge device and the conveyor, wherein the lower discharge device is driven so as to discharge the impurities from the tank to the conveyor, and thereafter the lower discharge device is stopped, wherein the supply of the cleaning gas to the lower valve is resumed so as to remove the impurities from the lower valve, the supply of the cleaning gas to the lower valve is stopped and thereafter, and wherein the lower valve is actuated so as not to communicate the lower discharge device and the conveyor.

6. A method for conveying impurities in a pressurized fluidized bed incinerator system including:

a pressurized fluidized bed incinerator for burning a material to be treated;

a turbocharger having a turbine rotated by a flue gas discharged from the pressurized fluidized bed incinerator and a compressor rotated according to the rotation of the turbine for supplying a compressed air as a combustion air to the pressurized fluidized bed incinerator;

a dust collector for collecting the impurities in the flue gas, being provided between the pressurized fluidized bed incinerator and the turbocharger; and an apparatus for conveying the impurities, having an upper valve provided between an upper discharge device for discharging the impurities from the dust collector and a tank for saving the impurities, and a lower valve provided between a lower discharge device for discharging the impurities from the tank and a conveyor for conveying the impurities to a hopper, the method comprising the following steps:

the pressure in the tank is increased;

the cleaning gas is supplied to the upper valve so as to remove the impurities from the upper valve;

the supply of the cleaning as to the upper valve is stopped, and thereafter;

the upper valve is actuated so as to communicate the upper discharge device and the tank;

the upper discharge device is driven so as to discharge the impurities from the dust collector to the tank, and thereafter;

the upper discharge device is stopped;

the supply of the cleaning gas to the upper valve is resumed so as to remove the impurities from the upper valve, the supply of the cleaning gas to the upper valve is stopped, and thereafter; and the upper valve is actuated so as not to communicate the upper discharge device and the tank, wherein while the cleaning gas is not supplied to the upper valve, a cooling gas is supplied to the upper valve.

* * * * *